US005470035A

United States Patent [19]

Sargis

[11] Patent Number: 5,470,035

[45] Date of Patent: Nov. 28, 1995

[54] ELECTRICAL SWITCH STAND

[75] Inventor: Isaac Sargis, Morton Grove, Ill.

[73] Assignee: National Trackwork, Inc., Itasca, Ill.

[21] Appl. No.: 298,102

[22] Filed: Aug. 30, 1994

Related U.S. Application Data

[63] Continuation-in-part of Ser. No. 268,478, Jun. 30, 1994, which is a continuation of Ser. No. 926,063, Aug. 5, 1992, abandoned.

[51] Int. Cl.[6] ..... B61L 5/06

[52] U.S. Cl. ..... 246/221; 246/411; 246/476

[58] Field of Search ..... 246/219, 220, 246/221, 240, 263, 393, 401, 402, 405, 406, 410, 411, 476

[56] References Cited

U.S. PATENT DOCUMENTS

| | | | |
|---|---|---|---|
| 140,917 | 7/1873 | Hanchett . | |
| 175,423 | 3/1876 | Chambers . | |
| 378,025 | 2/1888 | Tracy . | |
| 383,654 | 5/1888 | Pollock . | |
| 406,500 | 7/1889 | Boyd . | |
| 791,026 | 5/1905 | Hanlon | 246/221 |
| 856,336 | 6/1907 | Carter . | |
| 907,114 | 12/1908 | Anderson . | |
| 993,089 | 5/1911 | McGuire . | |
| 1,024,279 | 4/1912 | Osburn . | |
| 1,031,404 | 7/1912 | Wenrich . | |
| 1,140,965 | 5/1915 | DuBois et al. . | |
| 1,169,106 | 1/1916 | Anderson . | |
| 1,278,623 | 9/1918 | Fleagle . | |
| 1,318,767 | 10/1919 | Kimack . | |
| 1,418,127 | 5/1922 | Cesar . | |
| 1,478,888 | 12/1923 | Butler . | |
| 1,799,008 | 3/1931 | Dougherty . | |
| 2,045,930 | 6/1936 | Taylor . | |
| 2,559,477 | 7/1951 | Stephenson . | |
| 2,986,630 | 5/1961 | Maynard | 246/221 X |
| 3,449,562 | 6/1969 | Wilson et al. | 246/411 |
| 3,621,237 | 11/1971 | Hylen | 246/411 |
| 3,622,780 | 11/1971 | McCain | 246/476 |
| 3,652,849 | 3/1972 | Kleppick . | |
| 3,691,371 | 9/1972 | Hylen | 246/393 |
| 4,093,163 | 6/1978 | Larsson | 246/220 |
| 4,337,914 | 7/1982 | Rich . | |
| 4,896,850 | 1/1990 | Carmes | 246/476 |
| 5,050,823 | 9/1991 | Parker | 246/393 X |
| 5,052,642 | 10/1991 | Peters . | |

FOREIGN PATENT DOCUMENTS

| | | | |
|---|---|---|---|
| 410936 | 1/1991 | European Pat. Off. | 246/221 |
| 273810 | 11/1989 | Germany | 246/221 |
| 4244475 | 9/1992 | Japan | 246/406 |
| 14247 | of 1895 | United Kingdom . | |
| 16142 | of 1904 | United Kingdom . | |

*Primary Examiner*—Michael S. Huppert
*Assistant Examiner*—Scott L. Lowe
*Attorney, Agent, or Firm*—McDermott, Will & Emery

[57] ABSTRACT

An electrical railroad switch stand is disclosed in which a handle connected to a switching device is moved between a first position and a second position by use of an actuator powered by a motor. The direction of rotation of the shaft of the motor is controlled to control the position of the handle. Lights are provided to indicate the status of the switching device.

17 Claims, 7 Drawing Sheets

ELECTRICAL SWITCH STAND

RELATED APPLICATIONS

This is a continuation-in-part of U.S. Ser. No. 08/268,478, filed Jun. 30, 1994, now pending, which is a continuation of U.S. Ser. No. 07/926,063, filed Aug. 5, 1992, now abandoned.

FIELD OF THE INVENTION

This invention relates to railroad switching devices and particularly to railroad switch stands.

BACKGROUND OF THE INVENTION

Railroad yards generally have manually and/or automatically operated switching devices for switching railroad cars from one track to another. These switching devices are well known in the art and have been described for example, in U.S. Pat. Nos. 3,652,849 and 4,337,914 both incorporated by reference herein and made a part hereof.

Generally, a pair of stationery rails and a pair of switching rails are arranged so that the switching rails can be moved to keep trains on a main track or divert them to a branch track. The switching rails are moved by a switching device which includes a connecting rod that extends beneath the tracks to connections with the switching rails.

The switching devices typically include a switch stand to one side of the rails which can be operated either manually or automatically. When operated by hand, the switch is moved to a switch point by throwing a lever arm 180 degrees. For example, in the prior art, a weighted lever arm lying horizontally on the ground or at the base of the switch stand is lifted and thrown 180 degrees to the opposite side of the switch stand where it rests again horizontally on the ground or base. The weight and horizontal position of the lever arm prevents bouncing and accidental repositioning of the switch which could cause derailment. However, due to the large arc of throwing the lever arm and the amount of force and bending over required to carry out this operation, many switchmen have experienced back compression and resulting back and leg injuries. In U.S. Ser. No. 08/268,478, filed Jun. 30, 1994 by the same inventor named herein and assigned to the same entity, a switch stand is disclosed in which a lever arm is rotated less than 180 degrees to effect switching.

Other prior art switch stands have used hydraulic cylinders to effect switching. However, the hydraulic fluid of such cylinders tends to thicken during cold weather, thus tending to make the hydraulic cylinder slow to move, or, in the worst case, locking the cylinder such that no movement occurs.

SUMMARY OF THE INVENTION

The present invention eliminates the foregoing disadvantages in the art of railroad switch stands by providing an electrical railroad switch stand for moving switching rails of a railroad track including a switching device for switching rails of a railroad track. The switching device is actuated by a handle. The actuator rod of an actuator is coupled to the handle and is movable between an extended position and a retracted position. The position of the actuator rod controls the position of the handle and, thus, the status of the switching device. The actuator is driven by a motor whose direction of rotation can be controlled.

It is an object of the present invention to provide a switch stand which eliminates or significantly reduces back bending and switch throwing force which may cause back and leg injuries to switchmen, while still enabling a simple switch stand construction.

Another object of the invention is to provide a railroad switch stand that can be operated in cold temperatures.

A further object of the invention is to provide a railroad switch stand that can be operated by actuating one or more electrical switches.

An additional object of the invention is to provide a railroad switch stand that can be operated by remote control.

Still a further object of the invention is to provide a railroad switch stand that uses an actuator mechanically driven by a motor.

Still an additional object of the invention is to provide a railroad switch stand that uses a non-hydraulic actuator.

Another object of the invention is to provide a railroad switch stand that uses two or more lights to indicate the switching status of the stand.

Still another object of the invention is to provide an electrical railroad switch stand that can be operated manually in the event of a power failure.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DETAILED DESCRIPTION OF THE PREFERRED EMBODIMENT

Figure 1:
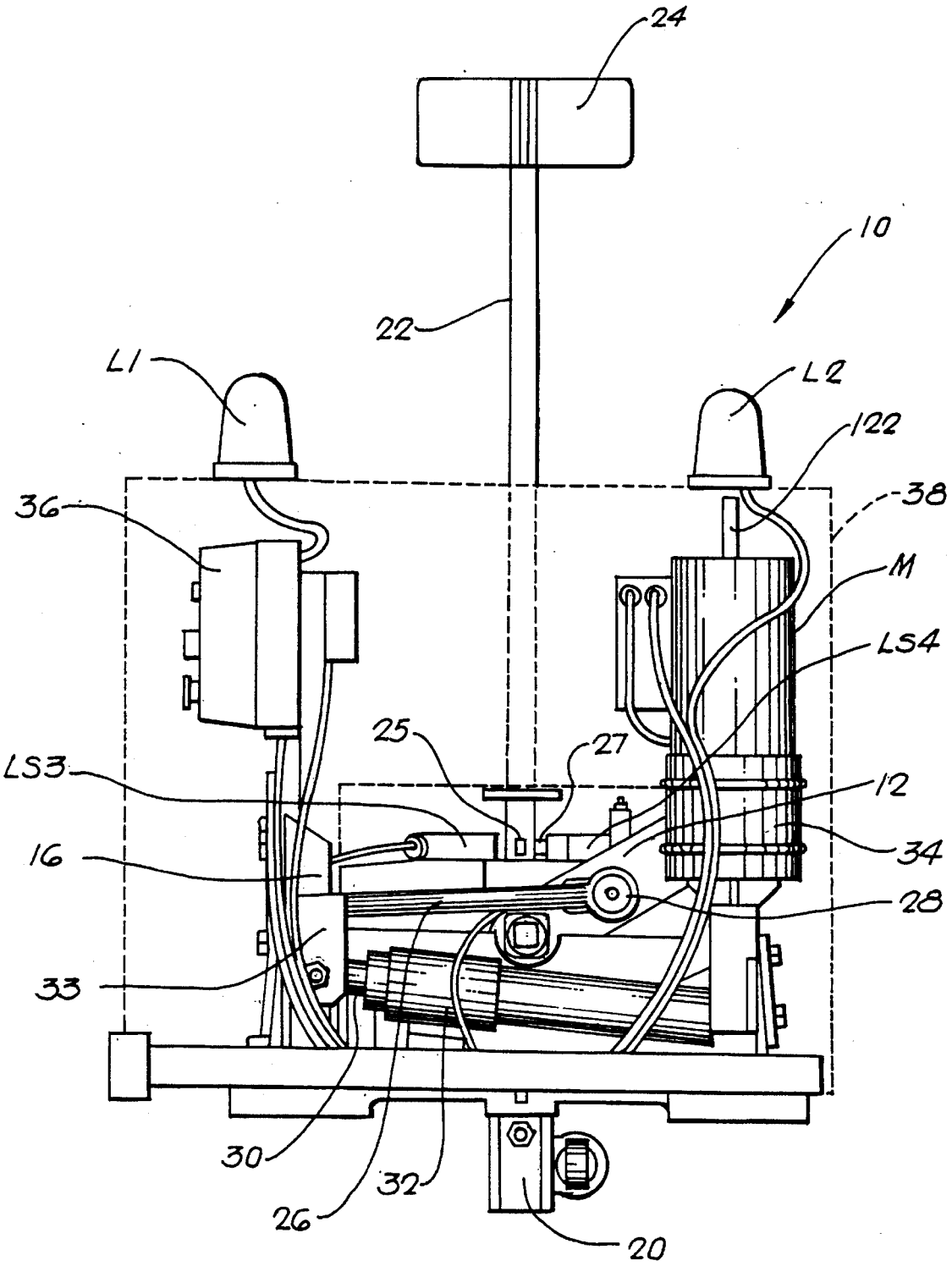
FIG. 1 is a front elevational view of an electrical switch stand embodying the present invention in one operational state.
Figure 2:
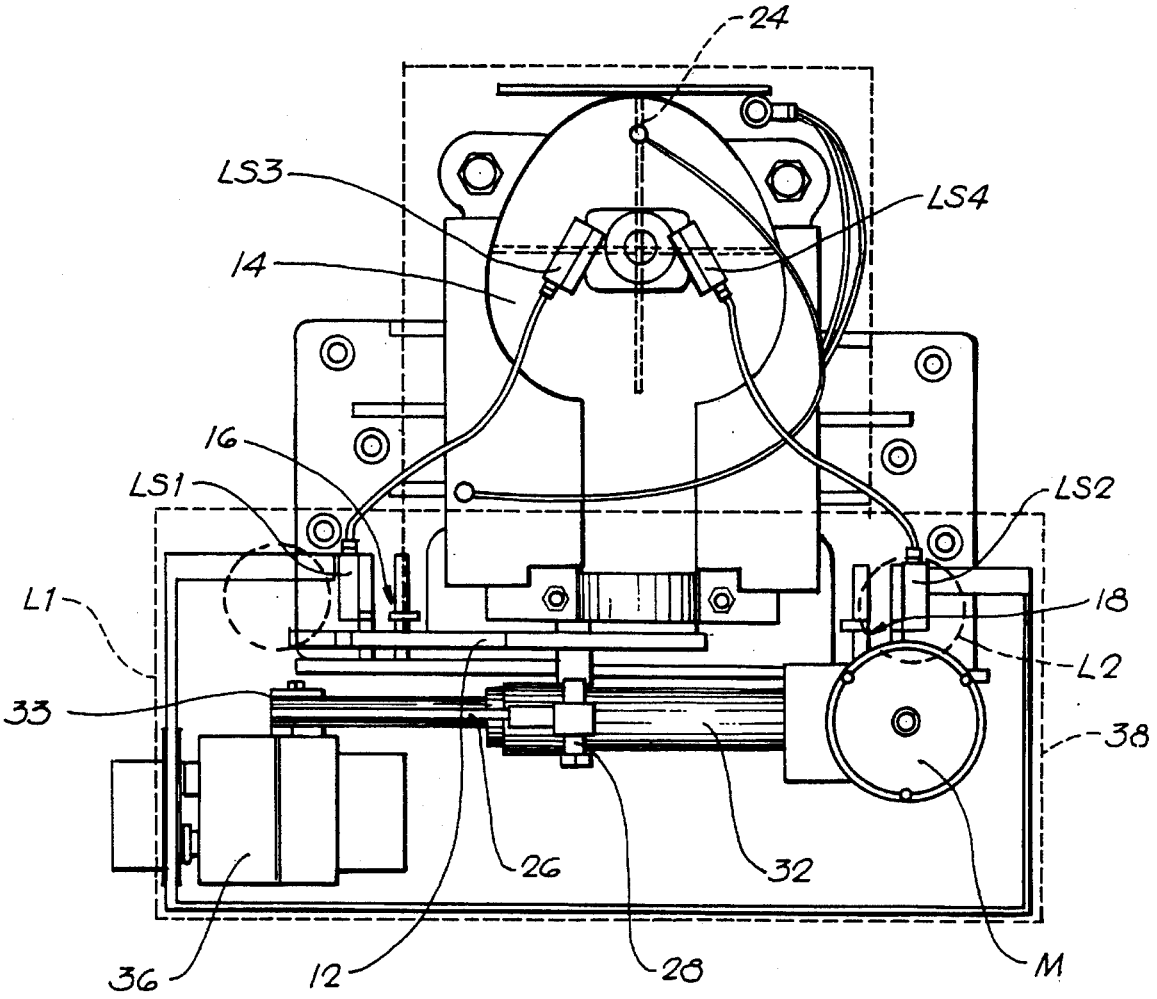
FIG. 2 is a top view of electrical switch stand of FIG. 1.
Figure 3:
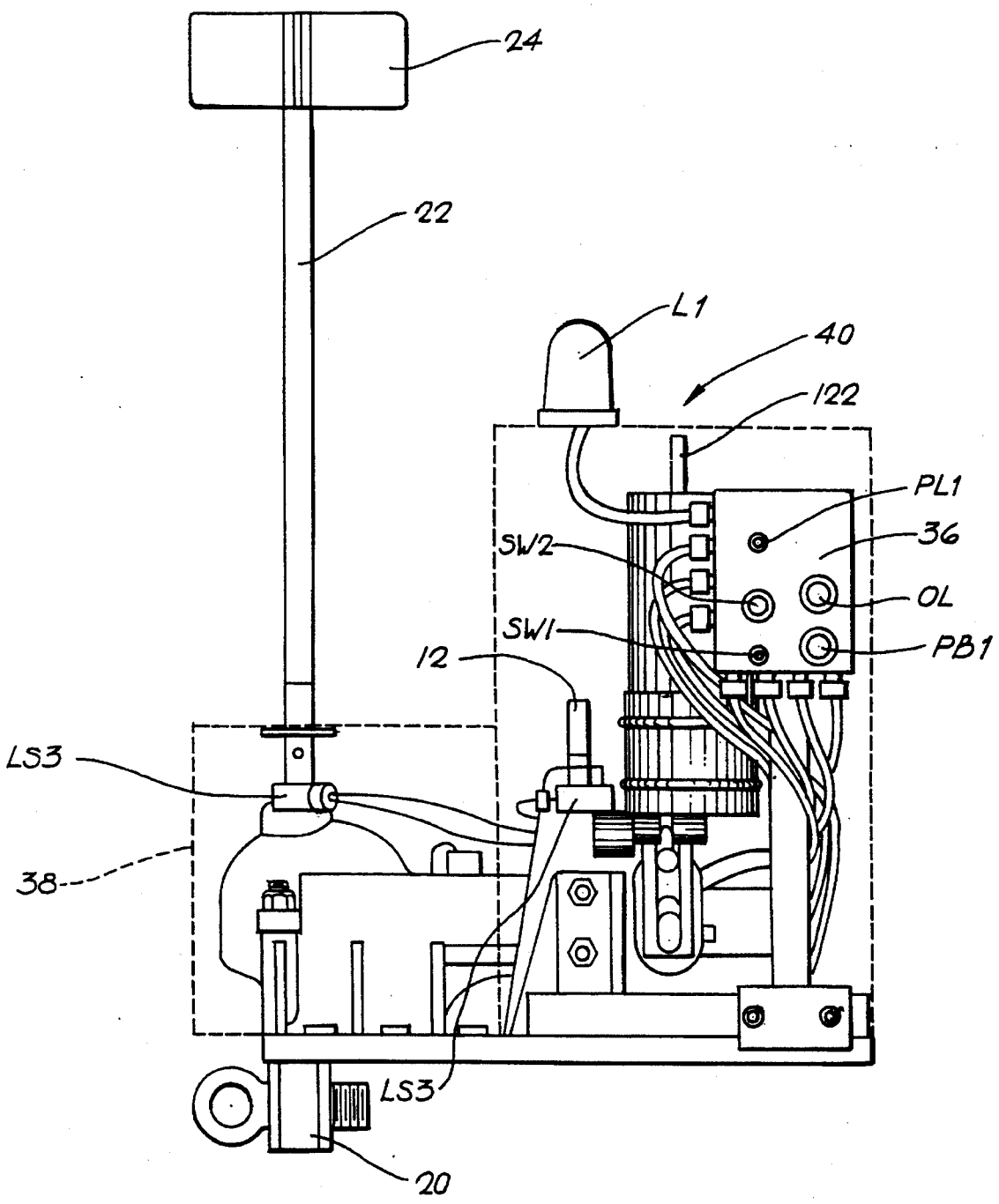
FIG. 3 is a left side view of the electrical switch stand of FIG. 1.
Figure 4:
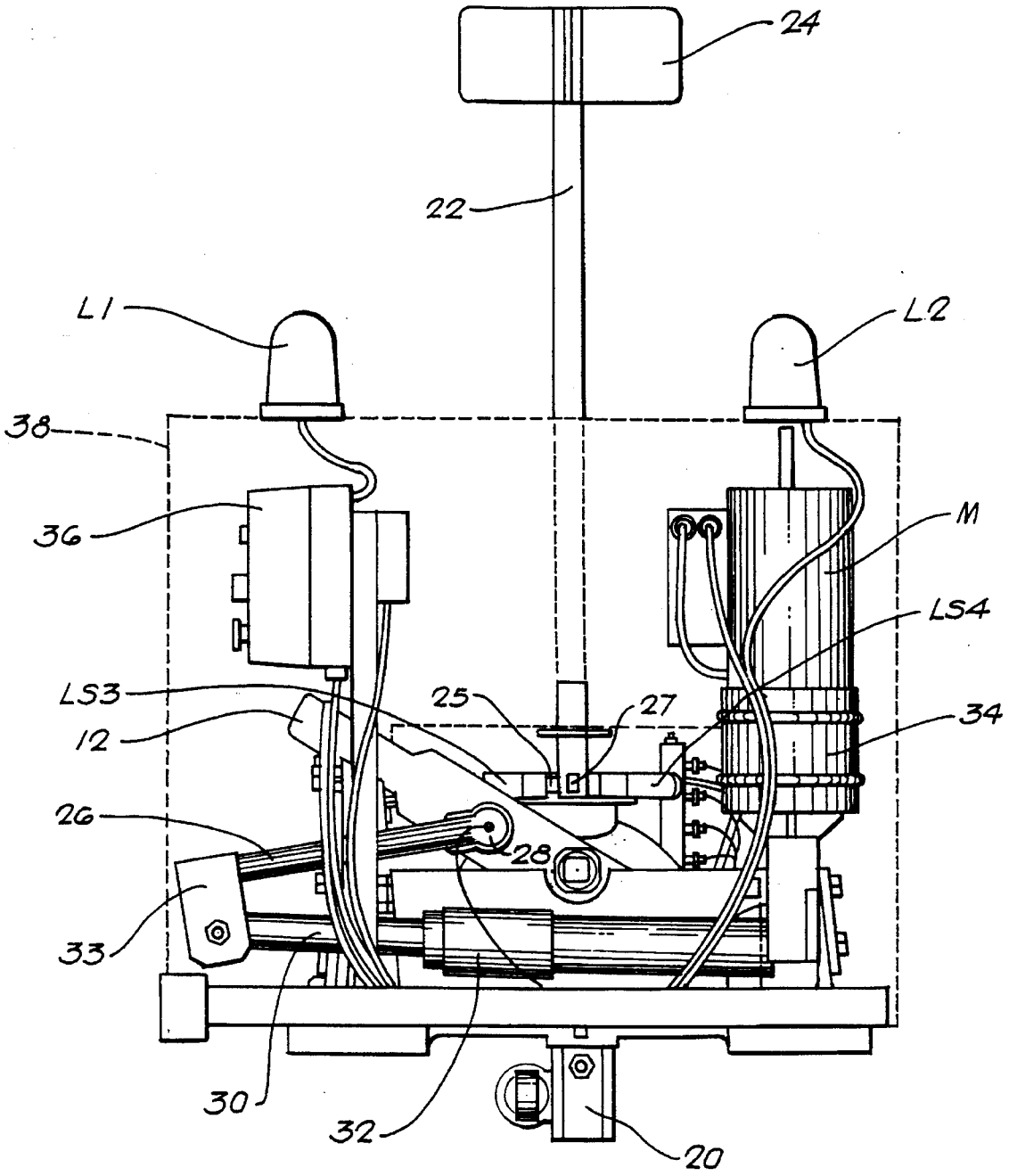
FIG. 4 is a front elevational view of the electrical switch stand of FIG. 1 in another operational state.

FIGS. 1, 2, 3 and 4 show one embodiment of the present invention. An electrical switch stand 10 includes a switch handle 12 movable between a first position, as shown in FIG. 4 and a second position, as shown in FIG. 1. Cradle 16 supports handle 12 when it is in the first position and cradle 18 supports handle 12 when it is in the second position. The arc defined by the movement of handle 12 between the first position and the second position is preferably less than 120 degrees, although greater arcs may also be used. Cradles 16 and 18 preferably support handle 12 at an angle of 40 to 45 degrees with respect to the surface on which switch stand 10 rests.

Movement of handle 12 from the first position to the second position operates a conventional switching mechanism 14. Any type of conventional railroad track switching mechanism may be used. Preferably a direct mechanical throw action switch of the type manufactured and sold by National Trackwork, Inc. 1500 Industrial Drive, Itasca, Ill. as model number 1003A, is used. However, other types of conventional switching mechanisms may also be used, including those employing a gear ratio action. Switching mechanism 14 operates to move a conventional connecting rod 20 secured by conventional means to a pair of switch points on a pair of alternative railroad tracks. When the handle 12 is in the first position resting in cradle 16, a train moves along one set of tracks, and when the handle 12 is in the second position in cradle 18, a train moves along a second set of tracks. Normally closed limit switch LS1 is located at cradle 16 and normally closed limit switch LS2 is located at cradle 18. When handle 12 rests on cradle 16, limit switch LS1 is opened and when handle 12 rests on cradle 18, limit switch LS2 is opened.

As is conventional in the art, a shaft 22 extends upwardly from the switching mechanism 14. A target 24 is fixedly attached to shaft 22 and preferably includes four plates mounted at 90 degree intervals. Two plates are of a first color and two are of a second color. Two plates located in the same plane are matched so as to be of the same color. As the switching mechanism 14 acts to switch tracks, shaft 24 rotates, thus causing target 24 to rotate. In a preferred embodiment, shaft 22 and target 24 rotate 90 degrees as the handle 12 is moved between the first and second positions. The intersecting colored plates are fixed to shaft 22 such that the target 24 will show a single color to those viewing the target 24 from the front and from the rear when the switch handle 12 is in either the first position or the second position, i.e., when the connecting tracks are switched a first way or a second way. The color corresponding to the first position will be different from the color corresponding to the second position. Preferably the two colors used are green and yellow, although other colors may also be used. In this way the position of the tracks may be readily determined by viewing the target 24. Extension 25 and 27 extend from the base of shaft 22 and selectively engage normal closed limit switches LS3 and LS4, respectively, as shaft 22 rotates.

Motor M is a conventional AC-powered motor, preferably ½ horsepower, 1140 RPM. Motor shaft 122 extends above motor M and below motor M into motor brake 34.

Figure 5:
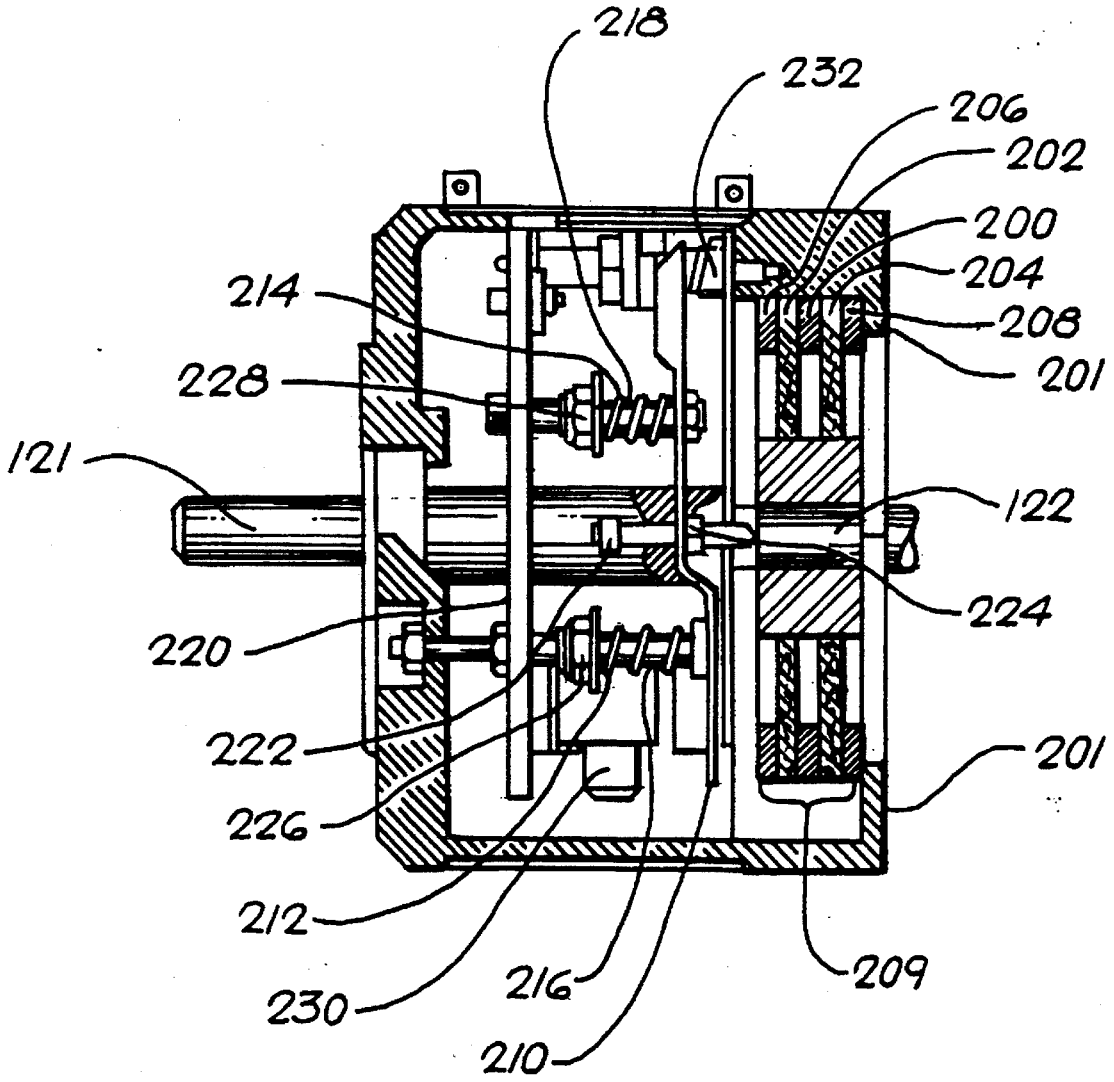
FIG. 5 is a partial cross-sectional view of a motor brake of one embodiment of the present invention.

As shown in FIG. 5, brake 34 is a conventional electromagnetic disc brake. Motor shaft 122 is received by brake 34 and engages brake shaft 121. Motor shaft 122 is attached to disk 200, such that disk 200 rotates with motor shaft 122. Brake shoes 206 and 208 are located on either side of disk 200, but are not attached to motor shaft 122. Friction disk 202 is fixedly attached to brake shoe 206 and is located between disk 200 and brake shoe 206. Friction disk 204 is fixedly attached to brake shoe 208 and is located between disk 200 and brake shoe 208. Preferably, disk 200 and brake shoes 206 and 208 are made of a high-strength steel alloy and friction disks 202 and 204 are made of a steel impregnated asbestos material; however other similar types of materials could be used. Brake shoe 208 abuts housing 201, as will be described in detail below. Together, disk 200, friction disks 202 and 204 and brake shoes 206 and 208 form disk pack 209.

Armature plate 210 is biased toward brake shoe 206 by means of torque springs 212 and 214 which are supported by bolts 216 and 218. Bolts 216 and 218 pass through fixed plate 220 and armature plate 210. Two adjustment screws, only one of which is shown at 222, are threaded through armature plate 210 and retained by nut 224. An end of each adjustment screw is biased by the force of torque springs 212 and 214 into engagement with brake shoe 206, thus compressing disk pack 209. This results in brake shoes 206 and 208 frictionally engaging friction disks 202 and 204, respectively. When disk 200 is rotating (i.e., motor shaft 122 is rotating), this frictional engagement forces disk 200 to stop rotating, thereby braking the rotation of motor shaft 122 and brake shaft 121. The force placed on the disk pack 209 may be adjusted by turning locknuts 226 and 228 to adjust the length of torque springs 212 and 214, respectively. The force is selected to quickly stop rotation of motor shaft 122 when power is removed from motor M and to lock the motor shaft 122 when no power is applied to motor M.

Electromagnet assembly 230 is positioned between fixed plate 220 and armature plate 210. When power is applied to electromagnet assembly 230, a force sufficient to overcome the force of torque springs 212 and 214 is applied to armature plate 210, thus moving armature plate 210 into engagement with electromagnetic assembly 230 and away from disk pack 209. Adjustment screws 222 move away from and disengage brake shoe 206, thus substantially reducing the frictional force created between out plates 206 and 208 and friction disks 202 and 204. This results in release of the brake 34.

Figure 6:
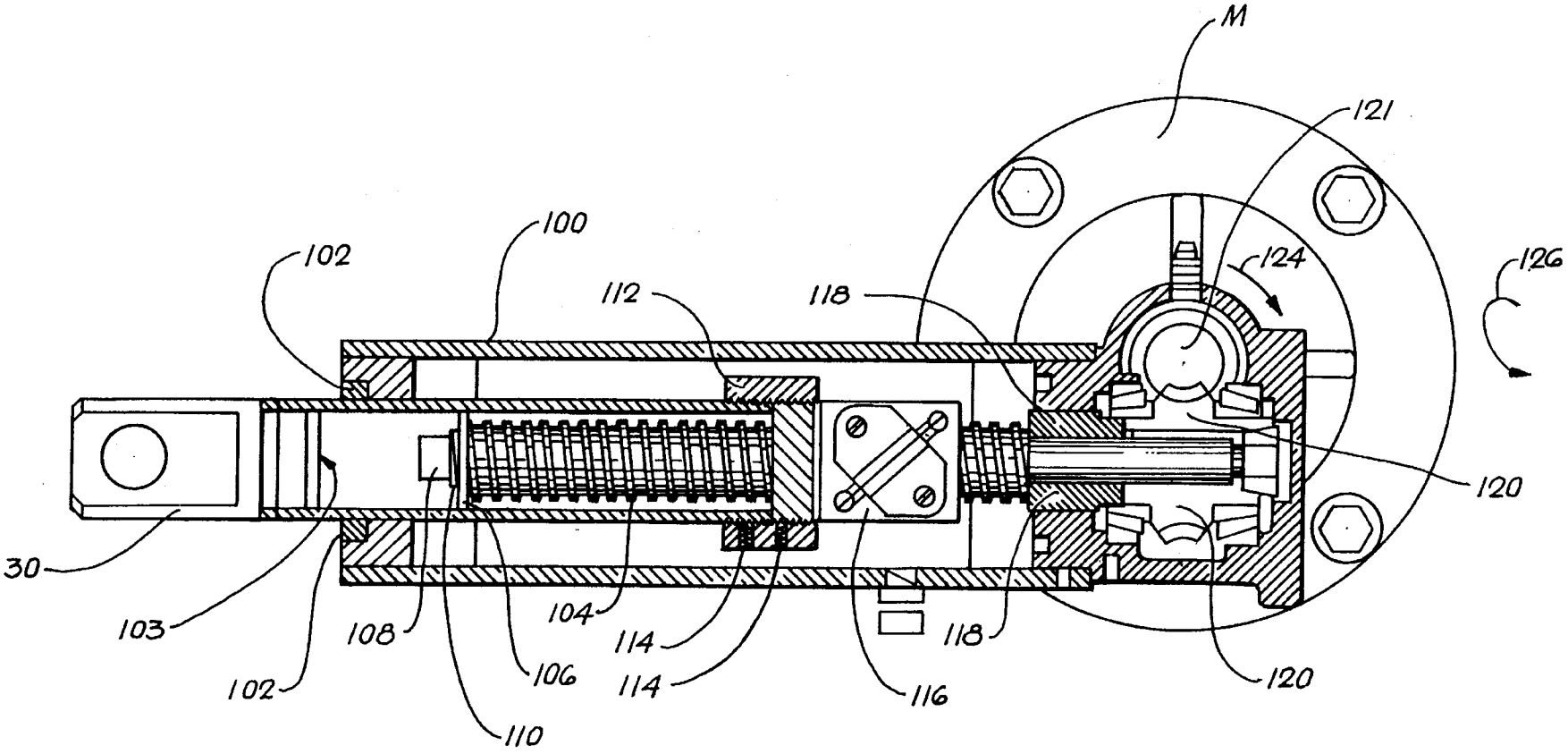
FIG. 6 is a partial cross-sectional view of an actuator of one embodiment of the present invention.

Brake 34 may also be manually released by manually moving armature plate 210 away from disk pack 209. This can be accomplished by using a releasable wedging mechanism, not shown, which inserts a wedge at point 232 to move armature plate 210 away from disk pack 209. Such a mechanism is common in electromechanical braking systems of the type described herein. Actuator 32 is of conventional design. As shown in FIG. 6, actuator 32 includes cylinder housing 100 which receives actuator rod 30 via bushing 102. Rod 30 is bored up to surface 103 to receive threaded rod 104. Stop disk 106 is attached to the end of threaded rod 104 via socket head cap screw 108 and lock washer 110. Threaded coupling 112 is attached to the interior end of actuator rod 32 via set screws 114 and other set screws, not shown, spaced evenly about the coupling 112. Threaded rod 104 passes through threaded coupling 114 and ball nut 116 and narrows to a smooth shaft that passes through bushing 118. Threaded rod 104 terminates with longitudinal projections 120 even spaced about the periphery of its shaft. Longitudinal projections 120 engage threaded brake shaft 121 such that rotational movement can be transferred from brake shaft 121 to threaded rod 104.

In operation, when brake shaft 121 rotates in a clockwise direction as shown by arrow 124, threaded rod 104 rotates in a counterclockwise direction, as shown by arrow 126. As threaded rod 104 rotates in a counterclockwise direction, coupling 112 is forced toward bushing 102, thus forcing (i.e., extending) actuator rod 30 out of cylinder 100.

When brake shaft 121 rotates in a counterclockwise direction (i.e., opposite to the direction shown by arrow 124), threaded rod 104 rotates in a clockwise direction (i.e., opposite to the direction shown by arrow 126). As threaded rod 104 rotates in a clockwise direction, coupling 112 is forced in a direction away from bushing 102, thus pulling (i.e., retracting) actuator rod into outer tube 100.

As those of ordinary skill in the art will appreciate, by changing the direction of the threads on brake shaft 121 and/or threaded rod 104 and/or coupling 112, actuator rod 30 can be forced out of cylinder 100 when brake shaft 121 rotates in a counterclockwise direction and pulled into cylinder 100 when brake shaft 121 rotates in a clockwise direction. In addition, by changing the pitch of the threads on brake shaft 121 and/or threaded rod 104 and coupling 112, the speed at which actuator rod 30 is extended and retracted may be adjusted. Also, the speed of rotation of brake shaft 121 can be adjusted to adjust the speed at which actuator rod 30 is extended and retracted.

Actuator rod 30 is connected to lever arm 26 via bracket 33 and lever arm 26 is rotatably connected to handle 12 via shoulder bolt 28.

Operation of switch stand 10 is controlled by an operator using electrical control panel 36. Housing 38 encloses most of the switch stand 10. Control panel 36 is accessible through a small door in housing 38, not shown. Signal lights L1 and L2 are mounted on top of housing 38 and provide colored light. The color of light L1 matches one color of target 24 and the color of light L2 matches the other color of target 24. Lights L1 and L2 are controlled such that the illuminated light is that which matches the color of target 24 when viewed from the front. Other types of signal devices keyed to the operation of the target 24 can also be used, including audible signalling devices, colored display panels, directional arrows or other symbols, and blinking lights.

Figure 7:
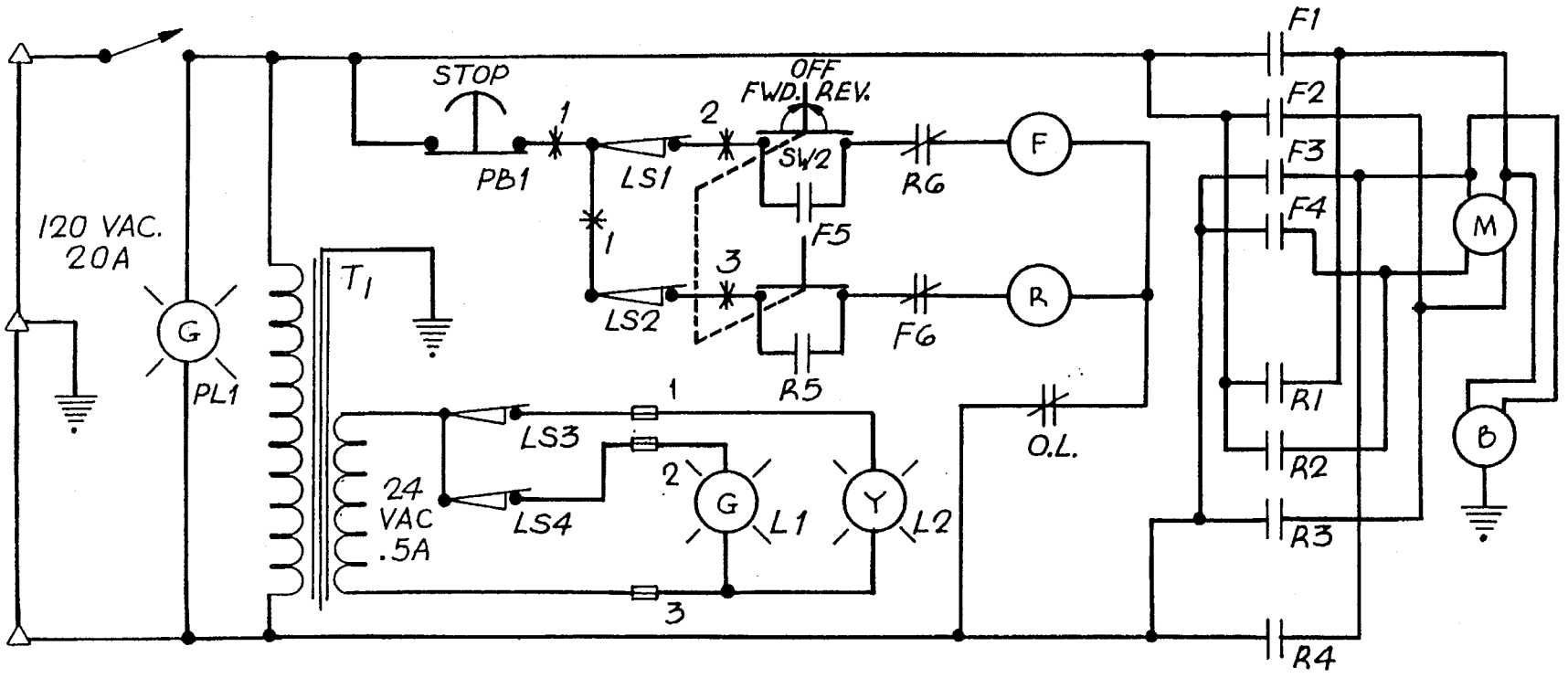
FIG. 7 is an electrical schematic diagram for the electrical switch stand of FIG. 1.

A schematic diagram illustrating the connection of the electrical components of the switch stand 10 is shown in FIG. 7. In the embodiment illustrated in FIG. 7, the electrical system is powered by 120 VAC, the standard household consumer voltage, obtained by normal methods from a utility company. Other power sources, including solar power, battery power or a portable generator, may also be used to power the electrical system. Power switch SW1 is connected in series with the power source to control power to the entire electrical system. Pilot light PL1 is connected to switch SW1 and is energized when switch SW1 is closed. Motor M is connected via normally-open relay contacts F1, F2, F3, F4, R1, R2, R3, R4 to the power source. Motor brake release B is connected to the power source via relay contacts F1, F3, R1, R4. When relay contacts F1, F2, F3, F4 are closed, motor brake release B is energized and motor M rotates in a clockwise direction. When contacts R1, R2, R3, R4 are closed, motor brake release B is energized and motor M rotates in a counter-clockwise direction.

Relay F includes normally open contacts F1, F2, F3, F4, F5 and normally closed contact F6. Relay R includes normally open contacts R1, R2, R3, R4, R5 and normally closed contact R6.

One leg of the coil of relay F is connected to one side of the power source via overload circuit breaker OL, which opens when an overload condition is present. The other leg of the coil of relay F is connected to one side of normally closed relay contact R6. The other side of relay contact R6 is connected to relay contact F5 and one pole of a first set of contacts for push button switch SW2. Relay contact F5 is connected in parallel with the first set of contacts for push button switch SW2. Normally closed limit switch LS1 is connected in series with the parallel combination of push button switch SW2 and relay contact F5.

One leg of the coil of relay R is connected to one side of the power source via normally closed relay contact OL. The other leg of the coil of relay F is connected to one side of normally closed relay contact F6. The other side of relay contact F6 is connected to relay contact R5 and one pole of a second set of contacts for push button switch SW2. Relay contact R5 is connected in parallel with the second set of contacts for push button switch SW2. Normally closed limit switch LS2 is connected in series with the parallel combination of push button switch SW2 and relay contact R5.

One pole of limit switch LS1 is connected to the corresponding pole of limit switch LS2 and to one pole of stop button PB1. The other pole of stop button PB1 is connected to one leg of the power source.

The voltage of the power source is stepped down from 120 VAC to 24 VAC via transformer T1. The stepped down voltage is applied to visual signal lights L1 and L2, via limit switches LS3 and LS4, respectively.

In operation, power switch SW1 is closed to provide power to the electrical system. When it is desired to throw the handle 12 from the first position to the second position, or from the second position to the first position, push button switch SW2 is turned in the proper direction and depressed. If the handle 12 is in the first position (i.e., resting in cradle 16), then limit switch LS1 is open and limit switch LS2 is closed. When push button switch SW2 is depressed in such a situation, the coil of relay F is energized and relay contacts F1, F2, F3, F4 and F5 are closed and relay contact F6 is opened, resulting in the locking in of power to the coil of relay F, the prevention of power being supplied to the coil of relay R, and the supplying of power to motor M so that motor M rotates in a clockwise, or forward, direction.

If the handle 12 is in the second position (i.e., resting in cradle 18), then limit switch LS2 is open and limit switch LS1 is closed. When push button switch SW2 is depressed in such a situation, the coil of relay R is energized and relay contacts R1, R2, R3, R4 and R5 are closed and relay contact R6 is opened, resulting in the locking in of power to the coil of relay R, the prevention of power being supplied to the coil of relay F, and the supplying of power to motor M so that motor M rotates in a counterclockwise, or reverse, direction.

The motor M may be stopped at any time by pushing stop button PB1, which opens the circuit providing power to the coil of relay F or the coil of relay R.

When the handle 12 is in the first position, target 24 is in its first position and limit switch LS3 is open. Under those conditions, light L1 is lit and light L2 is unlit. When the handle 12 is in the second position, target 24 is in its second position and limit switch LS4 is open. Under those conditions, light L2 is lit and light L1 is unlit. As shaft 22 rotates, neither limit switch is open and both light L1 and light L2 are lit. In an alternative embodiment, lights L1 and L2 are never lit at the same time and are only lit when a corresponding limit switch is being engaged.

Switch stand 10 may also be operated manually in the event there is an electrical power failure or other type of emergency situation. Manual operation is effected by manually releasing brake 34 and attaching a crank (not shown) to the upper end of motor shaft 122 by passing the shaft of the crank through opening 40. The upper end of motor shaft 122 can be formed to have a polygonal cross section, thus allowing it to be received by a mating polygonal bore in the handle. Other types of attachment mechanisms known to those of ordinary skill in the art may also be used. Once attached to motor shaft 122, the crank handle can be turned in either a clockwise or a counterclockwise direction to effect movement of handle 12 and actuation of switching mechanism 14.

Handle 12 may also be manually operated directly by removing shoulder bolt 28 and thereby disconnecting handle 12 from lever arm 26. Handle 12 may then be manually moved between the first position and the second position to actuate the switching mechanism 14.

Switch stand 10 may also be operated by remote control by employing known RF or infrared transmitters and receivers and electronic switching technology to replace or supplement switches SW1, SW2, PB1. Technology found in common remote control garage door openers or television remote controls can be employed for such a purpose in a manner known to those of ordinary skill in the art.

While various forms and modifications have been described above and illustrated in the drawings, it will be appreciated that the invention is not limited thereto but encompasses all variations and expedients within the scope of the following claims.

What is claimed is:

1. An electrical railroad switch stand for moving switching rails of a railroad track comprising:

(a) switch means for switching rails of a railroad track;

(b) handle means for actuating said switch means, said handle means movable from a first position to a second position;

(c) actuator means coupled to said handle means; said actuator means including an actuator rod and housing means for receiving said actuator rod, said actuator rod movable between an extended position and a retracted position with respect to said housing means, said actuator rod controlling the position of said handle means;

(d) motor means including a motor shaft coupled to said actuator means for moving said actuator rod between said extended position and said retracted position, said motor shaft rotatable in a first direction of rotation and a second direction of rotation;

(e) means for controlling the direction of rotation of said motor shaft; and (f) brake means for physically preventing rotation of said motor.

2. The railroad switch stand of claim 1 further including means for manually actuating said switch means.

3. The railroad switch stand of claim 2 wherein said means for manually actuating includes a crank coupled to said motor shaft.

4. The railroad switch stand of claim 1 further including signal indicating means for displaying the switching status of said switch means.

5. The railroad switch stand of claim 4 wherein said signal indicating means is a light.

6. The railroad switch stand of claim 1 wherein said actuator includes a threaded rod coupled to said motor.

7. The railroad switch stand of claim 6 further including signal indicating means for displaying the switching status of said switch means.

8. The railroad switch stand of claim 7 wherein said signal indicating means is a light.

9. The railroad switch stand of claim 6 wherein said means for controlling the rotation of said motor shaft includes electrical switch means.

10. The railroad switch stand of claim 9 wherein said electrical switch means is actuated from a location remote from said switch stand.

11. An electrical railroad switch stand for moving switching rails of a railroad track comprising:

(a) switch means for switching rails of a railroad track;

(b) handle means for actuating said switch means, said handle means movable from a first position to a second position;

(c) a lever arm attached to said handle means;

(d) actuator means attached to said lever arm; said actuator means including an actuator rod and housing means for receiving said actuator rod, said actuator rod movable between an extended position and a retracted position with respect to said housing means, said actuator rod controlling the position of said handle means;

(e) said actuator means further including a rotatable threaded rod coupled to said actuator rod, wherein rotation of said threaded rod effects movement of said actuator rod between said retracted position and said extended position;

(f) motor means including a motor shaft; said motor shaft rotatable in a first direction and in a second direction;

(g) brake means coupled to said motor shaft for stopping rotation of said motor shaft, said brake means including a brake shaft;

(h) said brake shaft coupled to said threaded rod to transfer rotational movement of said brake shaft to said threaded rod; and (i) means for controlling the direction of rotation of said motor shaft.

12. The railroad switch stand of claim 11 further including signal indicating means for displaying the switching status of said switch means.

13. The railroad switch stand of claim 12 wherein said signal indicating means is a light.

14. The railroad switch stand of claim 11 further including means for manually actuating said switch means.

15. The railroad switch stand of claim 14 wherein said means for manually actuating includes a crank coupled to said motor shaft.

16. The railroad switch stand of claim 11 wherein said means for controlling the rotation of said motor shaft includes electrical switch means.

17. The railroad switch stand of claim 16 wherein said electrical switch means is actuated from a location remote from said switch stand.

* * * * *